United States Patent [19]

Moore

[11] Patent Number: 5,005,642

[45] Date of Patent: Apr. 9, 1991

[54] LOGGING TOOL CENTRALIZER

[75] Inventor: Boyd B. Moore, Houston, Tex.

[73] Assignee: Shell Oil Company, Houston, Tex.

[21] Appl. No.: 428,528

[22] Filed: Oct. 30, 1989

[51] Int. Cl.[5] ..... E21B 17/10

[52] U.S. Cl. ..... 166/241; 175/325

[58] Field of Search ..... 166/241, 172, 173, 174; 175/325; 33/544.3

[56] References Cited

U.S. PATENT DOCUMENTS

| | | | |
|---|---|---|---|
| 3,555,689 | 1/1971 | Cubberly, Jr. | 33/544.3 |
| 4,228,593 | 10/1980 | Frank et al. | 33/544.3 |
| 4,595,055 | 6/1986 | Vannier | 166/241 |
| 4,615,386 | 10/1986 | Briscoe | 166/241 |
| 4,619,322 | 10/1986 | Armell et al. | 166/241 |
| 4,787,458 | 11/1988 | Langer | 166/241 |
| 4,790,381 | 12/1988 | Armell | 166/241 |
| 4,830,105 | 5/1989 | Petermann | 166/241 |

*Primary Examiner*—Bruce M. Kisliuk

[57] ABSTRACT

An apparatus for centralizing an elongated tool in a tubular member that provides a large centalizing force yet collapses easily when reaching an area of reduced diameter traveling in either direction. The apparatus has multiple pairs of arms, each arm having one end pivotally mounted on the tool with the opposite ends disposed adjacent to each other. The opposite ends of the arms are pivotally connected and a biasing means is provided for moving the opposite ends of the arms radially outward to provide the centralizing force. At least three pairs of arms are mounted on the tool at equal angular positions to accurately centralize the tool. The arms have rollers which contact the casing wall inside diameter which provide a very low friction for conveying the tool in this borehole even in high angle boreholes.

2 Claims, 3 Drawing Sheets

FIG. 5
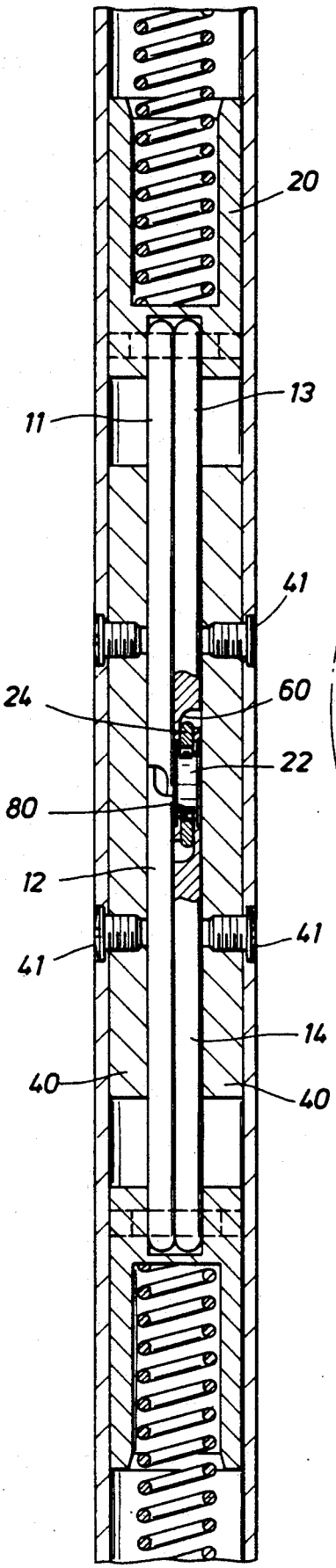
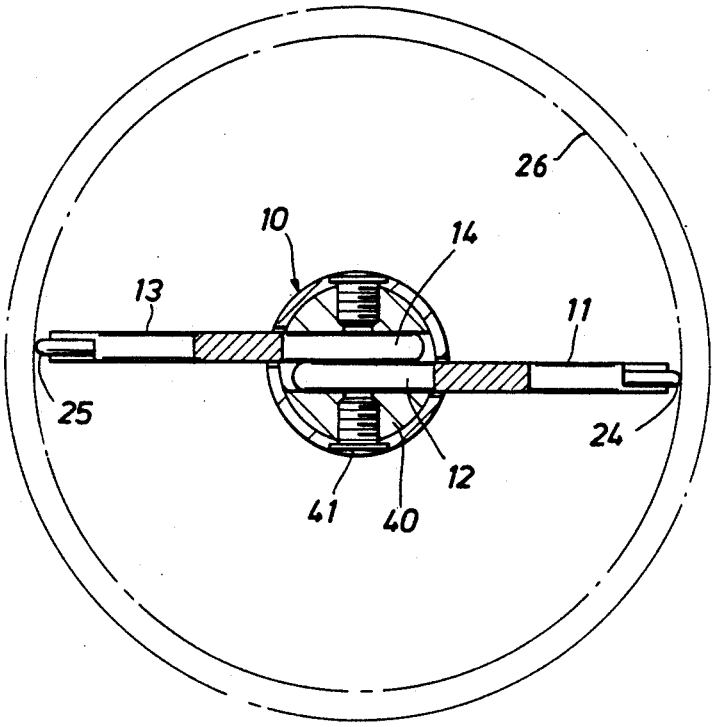
FIG. 6

LOGGING TOOL CENTRALIZER

BACKGROUND OF THE INVENTION

The present application relates to instruments and particularly to probes utilizing an elongated body that is inserted into tubular members or openings, for example, a tube inspection instrument which must be inserted into long tubes to inspect the interior of the tubes. Similarly, in the petroleum industry, numerous logging instruments are lowered into boreholes to take measurements of the formation surrounding the borehole. In all of these cases, it is necessary to center the instrument within the tube or the borehole or other opening to obtain accurate measurements.

In the past, the traditional method for centralizing an inspection tool within a tubular member or opening has been the use of bow springs placed around the circumference of the tool. The bow springs exert a force on the tube wall or the borehole wall that centers the tool within the opening. Bow springs are used since they easily deform when the tool passes an obstruction or a portion of the tube or borehole having a reduced diameter. Although the use of centralizing springs is satisfactory in a large number of instances, it does have a particular disadvantage, when used in boreholes, of allowing the instrument to assume an off center position. This occurs when the borehole is inclined and the weight of the instrument tends to deform the springs, which are high friction devices, on the low side of the borehole, and thus position the instrument in an off-center position. In many cases, the off-center position of the logging instrument does not affect the results obtained. In other cases it is desirable, and at times necessary, to ensure that the tool is accurately centered within the tube or the borehole opening.

In an attempt to provide a better means for centering the instrument in the opening, deformable wheels or rollers have been placed on the circumference of the instrument. The use of deformable rollers is possible in the case of tube inspection devices where the tubes have a uniform diameter and only a slight deformation of the rollers is required to allow the instrument to pass any obstruction that is encountered. This type of approach, of course, cannot be used in logging instruments which are lowered into boreholes since the changes in the diameter of the borehole are too great to be accommodated by mere deformable rollers. Thus, the problem exists of providing a means for accurately centering the logging tool in a borehole even in those cases where the borehole diameter changes rapidly. The problem is further complicated in those cases where it is necessary to lower the logging tool through a production tubing string and then allow it to exit out the bottom of the production tubing string into the borehole casing. In this case, the change in diameter can be a factor of 2 to 4 times which greatly exceeds the range that can be accommodated with deformable rollers. Accordingly, the present invention is directed to overcoming these and other problems experienced by the prior art.

SUMMARY OF THE INVENTION

The present invention solves the above problems by providing a system of pivoted arms which are biased so that they will extend radially outward a substantially equal distance on each side o: the instrument. The end of the arms which extend radially outward are provided with rollers which bear against the surface of the borehole or the tube or other opening into which the instrument is inserted. Rollers provide a very low friction for the conveyance of the tool arms and are able to pass a restriction in either direction. The use of arms which extend equally on each side of the instrument housing ensures that the tool will be accurately centered within the opening. When the tool approaches an area of reduced diameter the arms will be retracted equally on each side of the instrument and thus maintain the instrument centered within the opening.

The problem of the tool becoming of center that occurs in inclined boreholes is avoided by using a plurality of arms which are disposed at angular positions relative to each other. The centering force produced by each set of arms will depend primarily on the stiffness of the spring used to force the arms radially outward. Preferably, two sets of arms are used which are disposed at right angles to each. Thus, even if the weight o: the instrument would tend to retract the set of arms which are bearing on the low side of the borehole, the other set of arms which are at right angles would be only slightly affected by the weight of the instrument. As can be appreciated, if the roller of the arm is riding at the maximum diameter of the borehole and the force or weight of the instrument is tending to move the roller tangentially to the surface of the borehole, it will only exert a small force perpendicular to the arm which would tend to retract it. This in combination with the centering force produced by the other set of arms ensures that the instrument will remain centered even in the case of inclined boreholes.

Other purposes, distinctions over the art, advantages and features of the invention will be apparent to one skilled in the art upon review of the following.

BRIEF DESCRIPTION OF THE DRAWINGS

The actual construction, operation, and the apparent advantages of the present invention will be better understood by referring to the drawings in which like numerals identify like parts and in which:

FIG. 5 is a portion of FIG. 1 drawn to an enlarged scale.

FIG. 6 is a section taken along line 6—6 of FIG. 3.

DESCRIPTION OF THE PREFERRED EMBODIMENTS

Figure 1:
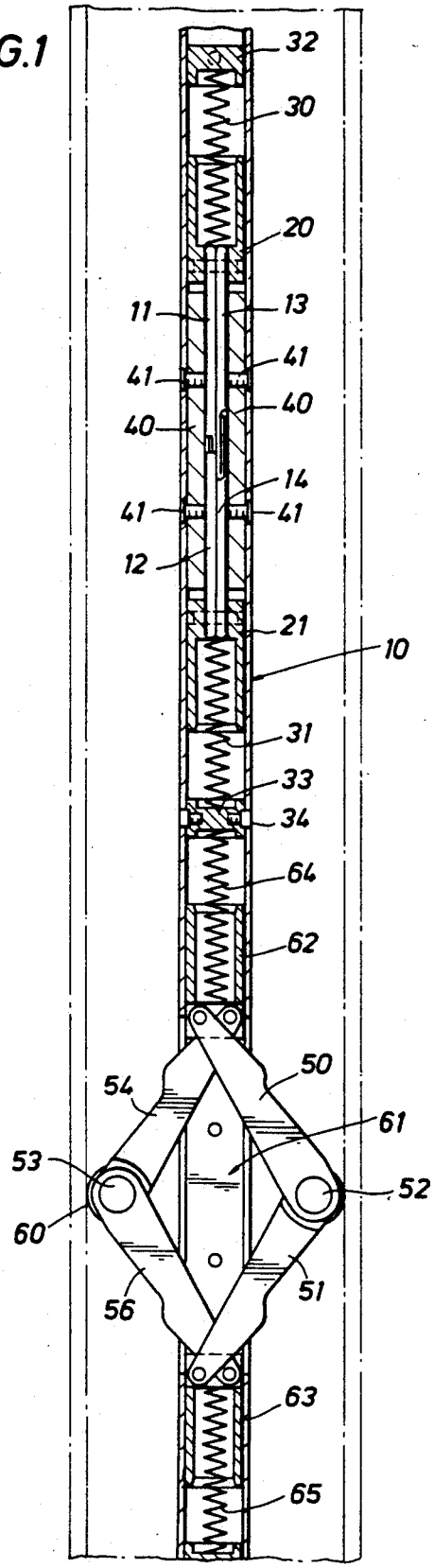
FIG. 1 is a longitudinal section of a borehole instrument incorporating the centralizing means of this invention.

Referring now to drawings, a tubular member or housing 10 forms part of the tool body that is to be inserted into a tubular member to inspect the interior surface thereof. The housing could also form part of a logging tool that is lowered into a borehole. Mounted on the tool body are four arms, 11–14. The arms 11 and 12 form one pair which are positioned so that they will extend radially outward to the right as seen in the drawings, while the arms 13 and 14 form a second pair which are extended an equal distance radially outward to the left. The arms 11 and 12 are pivoted at points 15 and 16 while the arms 13 and 14 are pivoted at points 17 and 18 respectively. The pivots 15 and 17 are carried by a support means 20 while the pivots 16 and 18 are carried by a similar support means 21. The support members 20 and 21 are generally cup-shaped and are disposed to move axially within the interior of the tubular housing 10. The recess formed in each of the support members is used to support one end of a compression spring 30, 31, 64 and 65 that provides a biasing force for moving the centralizing arms radially outward.

As seen in the drawings the pivot point for the arms 11 and 12 is positioned off the longitudinal axis of the tubular housing while the pivot points for the arms 13 and 14 are similarly positioned off-center, i.e., to the opposite side of center. The pivot points are set off-center so that even in the retracted position the force of the compression spring will always be capable of forcing the arms radially outward. It the arms were pivoted so that the pivot points 15 and 16 of the arms 11 and 12 became aligned with the common pivot 22 of the two arms they would be essentially locked in position and the spring would be incapable of extending the arms radially outward.

The arms 13 and 14 are pivoted at one end and extend in a direction toward each other so that their other ends are adjacent each other and can be joined by means of a common pivot pin 22. A suitable roller 24 rotates on the common pivot pin 22 of the arms and is designed to bear against the wall 26 of the well casing as shown in the drawings. The second pair of arms 13 and 14 similarly extend toward each other and are provided with a common pivot pin 23 and a suitable roller 25. The rollers 24 and 25 are preferably provided with a low-friction bearing means to provide very low friction for conveyance of the tool even in high angle holes.

Two compression springs 30 and 31 are provided for forcing or biasing the pairs of arms radially outward. In particular, one end of the spring 30 bears against a fixed bulkhead 32 at its upper end while the lower end of the spring bears against the recess in support means 20. The lower spring 31 bears against a similar fixed bulkhead 34 at its lower end while its upper end is retained within the recess formed in support member 21. The bulkheads 32 and 34 are held in a fixed position by means of cap screws which pass through the wall of the tubular housing and thread into the bulkhead members. A suitable stop means is provided for the support means 20 and 21 so that the centralizing arms will not be extended radially outward beyond preset limits. The stop means may be set to provide slight clearance with the inside diameter of the casing wall even when the arms are fully extended so that no force is applied to the rollers when traveling in the borehole. The stop means are formed by two semi-round members 40 that are mounted in the interior of the tubular housing and retained by means of cap screws 4!. The semi-round members 40 are sized so that there is adequate clearance between the two members for the centralizing arms 11-14. In addition to providing a means for limiting the movement of the centralizing arms the members 40 also supply lateral support for the arms so that they will not be twisted or otherwise deform as the tool is moved through a borehole or similar opening.

Figure 2:
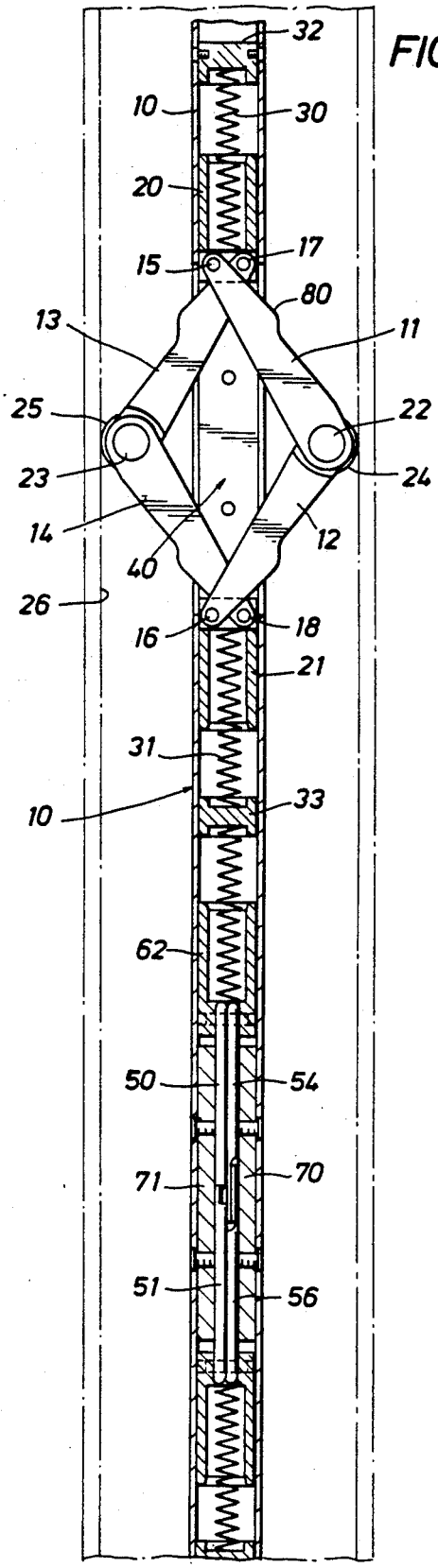
FIG. 2 is a longitudinal section of the instrument shown in FIG. 1 taken at 90 degrees from the section shown in FIG. 1.
Figure 3:
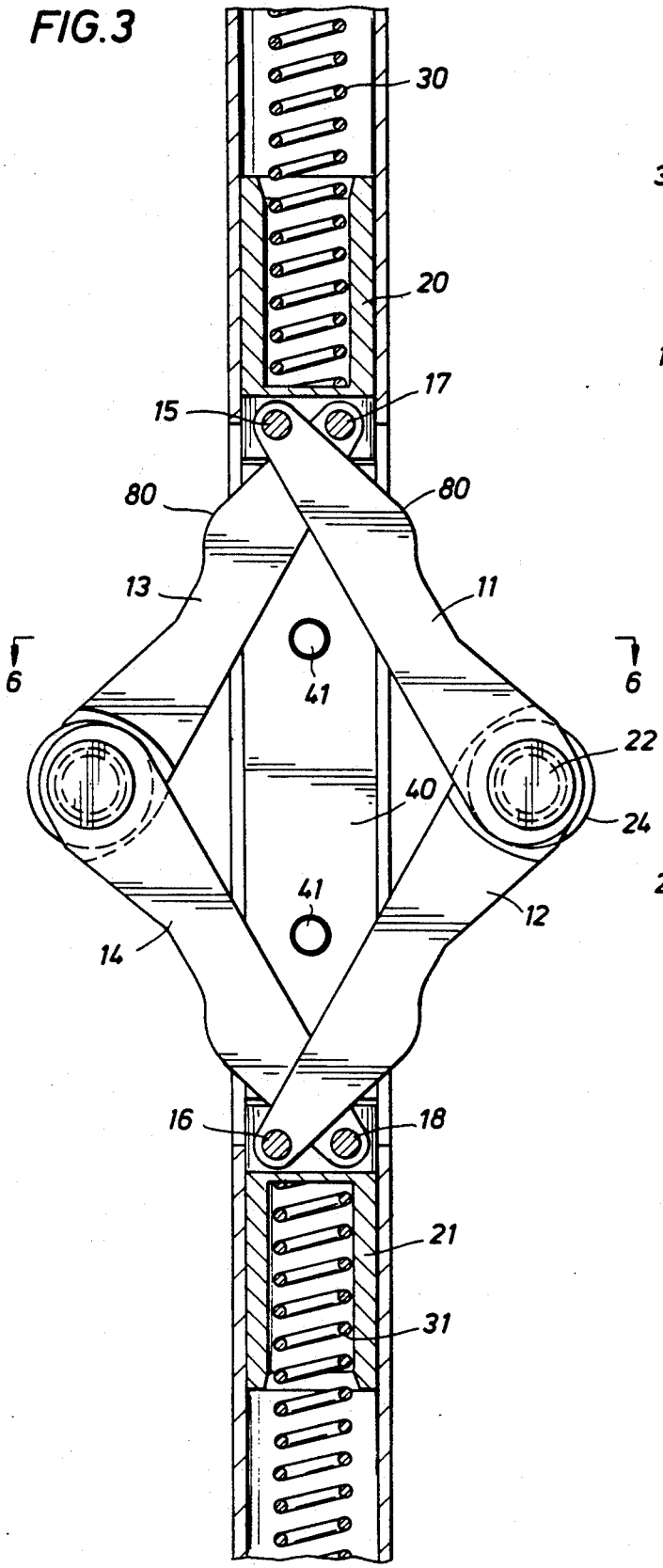
FIG. 3 is a portion of FIG. 2 drawn to an enlarged scale with the centralizing arms extended.
Figure 4:
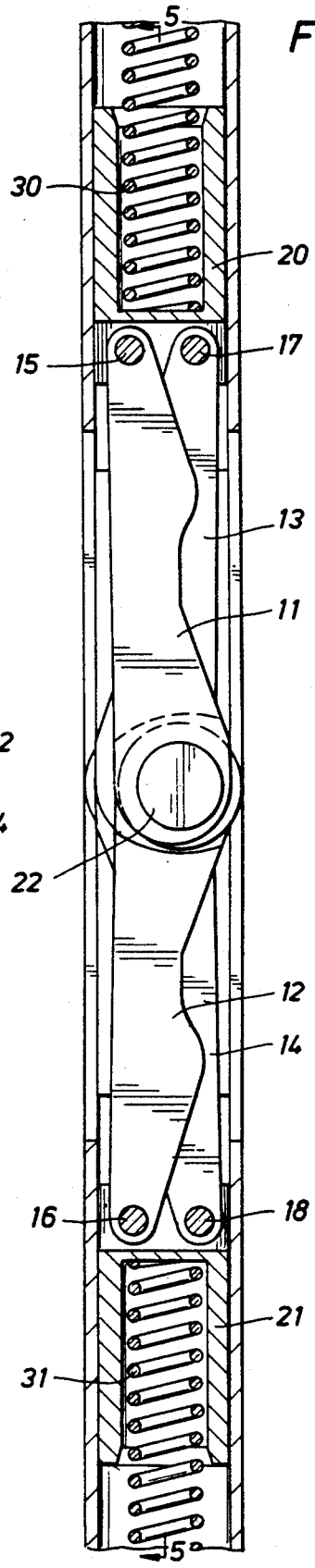
FIG. 4 is the same as FIG. 3 with the centralizing arms retracted.

Referring to the bottom portion of FIGS. 1 and 2, there is shown a third and fourth set of centralizing arms, more particularly arms 50, 51, 54 and 56. These arms are pivoted so that they extend radially outward in a plane that is at substantially right angles to the plane of arms 11-14 described above. Only the pivots 52 and 53 for the arms 50 and 51 are shown. These arms extend downwardly or away from the viewer as shown in the drawings while the arms 54 and 56 extend upwardly or toward the viewer. As can be appreciated from the description with relation to the arms 11-14, the pivot for the arms that extend downwardly would be closest to the viewer while the pivots for the arms 54 and 56 would be away from the viewer. A roller 60 for the set of arms 54 and 56 is shown in the drawings. Also shown is a relieved portion 61 of the end of the arm which provides a pocket or space for the roller 60. The arms 11-14 described above are similarly provided with relieved portions which are shown at 26 for the arm 12 described above. The set of arms 50-51 is provided with suitable support means 62-63 which also supply the support means for the set of arms 54-55. Similarly, spring means 64 and 65 are provided for biasing the arms radially outward as described above. The spring means are identical to those described above.

Referring to the arms 11-14 and particularly arm 11, they are provided with surfaces 80 that are so shaped and designed as to provide a force for moving the pairs of arms radially inward as the tool approaches an opening of reduced diameter. In particular, the surface 80 is formed so that it has a gradually curving section which will provide a large inward force while requiring only a slight force to move the housing axially. This can be appreciated since the ramp or increase in diameter of the portion of the arms that has the surfaces 80 is only slight with regard to the axial length of the arms. This will ensure that a large force is generated as the tool is moved through a restriction.

Referring to FIG. 6, there is shown a sectional view of the tool with the arms in an extended position and the rollers 24 and 25 in contact with the surface 26 of the well casing. FIG. 5 illustrates clearly how the individual arms are provided with reliefs at their adjacent ends to provide a space for the rollers. Also, it can be appreciated from FIG. 6 that the arms extend substantially horizontally and thus provide a means for maintaining the tubular housing centered within the borehole even if the companion set of arms (not shown) would tend to retract. This can be appreciated by visualizing the tendency of the tool to fall to the bottom of the drawing which would necessitate the rollers 24 and 25 on the arms moving tangentially or downward along the borehole wall. This movement would provide only a very small force tending to move the arms inward which force is easily overcome by the biasing action of the springs. Thus, the arms 11-14 will act to maintain the tool centered within the borehole. The combination of this action plus that of the companion set of arms will maintain the tool centered even in inclined boreholes.

From the above description of a preferred embodiment it can be appreciated that a centralizing system has been described that accurately centers the tool regardless of the forces tending to move the tool off center. The arms are extended equal distances on each side of the tool and center the tool, even in inclined boreholes, when the weight of the tool tends to force it off center. The stiffness of the springs can be selected to provide any desired centralizing force. Of course, a large centralizing force will increase the force on the rollers and the effort needed to move the tool through the borehole. A spring stiffness can be selected that produces adequate centralizing force without unduly increasing friction.

The foregoing description of the invention is merely intended to be explanatory thereof, and various changes in the details of the described apparatus may be made within the scope of the appended claims without departing from the spirit of the invention.

What is claimed is:

1. An apparatus for centralizing an elongated tool in a tubular member comprising:

(a) two pairs of centralizing arms radially displaced about the elongated tool, each pair of arms being pivotally connected at adjacent ends to each other and pivotally connected at opposite ends to the elongated tool;

(b) means for causing said opposite ends of each pair of centralizing arms to move closer together, thereby forcing said pivotally connected adjacent ends of each pair of centralizing arms to move radially outward from a retracted position adjacent the elongated tool and into contact with the tubular member; and (c) pivot points set off-center for connecting said opposite ends of the centralizing arms to the elongated tool body, each pair of centralizing arms crossing to reach respective opposite off-center pivot points, said pivot points being functional to prevent the centralizing arms from locking in said retracted position.

2. The apparatus of claim 1 wherein each centralizing arm has an outwardly facing surface formed with a gradually inwardly curving section functional to reduce resistance upon engagement of the arm with an opening of reduced diameter in the tubular member as the elongated tool moves therethrough, the inwardly curving section providing a large inward force resulting from a slight force to move the elongated tool axially.

* * * * *